US007946079B2

(12) United States Patent
Brown

(10) Patent No.: US 7,946,079 B2
(45) Date of Patent: May 24, 2011

(54) ELECTRICALLY DRIVEN ENTRYWAY ACTUATION SYSTEM

(75) Inventor: Cary L. Brown, Schaumburg, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 883 days.

(21) Appl. No.: 11/663,868

(22) PCT Filed: Sep. 27, 2005

(86) PCT No.: PCT/US2005/035114

§ 371 (c)(1),
(2), (4) Date: Oct. 22, 2007

(87) PCT Pub. No.: WO2006/037115

PCT Pub. Date: Apr. 6, 2006

(65) Prior Publication Data

US 2008/0196312 A1 Aug. 21, 2008

Related U.S. Application Data

(60) Provisional application No. 60/613,812, filed on Sep. 28, 2004.

(51) Int. Cl.
*E05F 15/00* (2006.01)

(52) U.S. Cl. ..... 49/139; 49/118; 49/122

(58) Field of Classification Search ..... 49/139, 49/140, 141, 116, 118, 122, 333, 334, 335, 49/338, 365, 366

See application file for complete search history.

(56) References Cited

U.S. PATENT DOCUMENTS

| | | | | | |
|---|---|---|---|---|---|
| 1,335,750 | A | * | 4/1920 | Pearson | 49/107 |
| 2,893,506 | A | | 7/1959 | Daugirdas | |
| 3,210,065 | A | * | 10/1965 | Linder et al. | 49/137 |
| 3,210,067 | A | * | 10/1965 | Ferguson et al. | 74/42 |
| 3,470,653 | A | * | 10/1969 | Kalog | 49/139 |
| 4,007,557 | A | * | 2/1977 | Davis et al. | 49/139 |
| 4,375,140 | A | | 3/1983 | Blair et al. | |
| 4,454,685 | A | | 6/1984 | van der Sloot et al. | |
| 5,332,279 | A | | 7/1994 | Golemis et al. | |
| 6,125,768 | A | | 10/2000 | Kurnik | |
| 6,575,864 | B1 | | 6/2003 | Dean | |
| 7,254,918 | B2 | * | 8/2007 | Fronz et al. | 49/122 |
| 2002/0162279 | A1 | | 11/2002 | Pagowski et al. | |

* cited by examiner

*Primary Examiner* — Jerry Redman
(74) *Attorney, Agent, or Firm* — The Webb Law Firm

(57) ABSTRACT

An electrically driven entryway activation system for opening and closing two spaced swinging doors hung on spaced rotating parallel door posts comprises a base plate extending between the door posts. Levers attached to each door post rotate in a plane parallel to the base plate. A low profile actuation system spaced between the levers comprises a center post, a sector gear journaled on the center post for rotation parallel to the base plate, and a low profile gearmotor mounted between the base plate and the sector gear. A low profile emergency manual mechanism is provided for unclutching the output pinion gear of the gearmotor.

6 Claims, 8 Drawing Sheets

ELECTRICALLY DRIVEN ENTRYWAY ACTUATION SYSTEM

BACKGROUND OF THE INVENTION

1. Field of the Invention

The present invention relates, in general, to an electric actuator and, more specifically, to an electric actuator for opening and closing the door to a vehicle.

2. Description of Related Art

Power door operators have been developed to reduce the strain on vehicle operators caused by the repeated opening and closing of vehicle doors. Many power door operators use pneumatic actuators because the air brake systems in mass transit vehicles provide a reliable and convenient source of air at controlled pressure. U.S. Pat. No. 4,454,685 is an example of such a power door operator.

Electric door actuators have also been developed. U.S. Pat. No. 5,332,279 discloses a power door operator for multi-passenger mass transit vehicles. This system uses electrical gear motor operating drive arms in order to open and close dual panel swing door sets. U.S. Pat. No. 6,125,768 discloses a door system for transit vehicles that uses an electrically driven operator to open and close the doors of a mass transit vehicle. Both of these prior art systems fail to efficiently use space and require motion in more than one plane of action.

Power door operators usually include an emergency release mechanism. A pre-existing design for the release mechanism is a toggle-based device. Such a toggle-based release mechanism is disclosed in U.S. Pat. No. 6,662,501.

Therefore, a need exists for an electric door actuator that maximizes space efficiency, while also ensuring that all motion occurs in a single plane. There is also a need for an actuator with a simple emergency release mechanism that is space and cost efficient.

SUMMARY OF THE INVENTION

Briefly, according to this invention, there is provided an electrically driven entryway actuation system which includes a base plate, a prime mover at the center of the base plate, a first pivot assembly connected to a first door, a second lever assembly connected to a second door, a first adjustable rod connecting the first lever assembly to the prime mover, a second adjustable rod connecting the second lever assembly to the prime mover, an emergency release mechanism connected to the prime mover, and a remote emergency release lever attached to the emergency release mechanism. The configuration of each of the above elements has been arranged for maximum space efficiency and to ensure that all motion occurs in a single plane of action. This allows the system to reduce inefficiency of operation, leading to a lower operational heat build-up, and reduced stress and strain on both the actuator mechanism and the bus frame.

The prime mover of the present invention includes a structural framework, a gearmotor package mounted on the structural framework, a sector gear assembly, with pivot posts and stops driven by the gearmotor, a center post joined to the structural framework for mounting the sector gear assembly, and limit switches mounted to the structural framework beneath the sector gear assembly.

According to a preferred embodiment, a sliding-wedge-style emergency release mechanism of the present invention includes an actuator lever with a first end and a second end. The first end is pivotally connected to the structural framework of the prime mover and the remote emergency release lever is connected between the first and second ends. A link rod is connected to and forms an approximate 90° angle with the actuator lever, a first wedge is attached to the link rod, and a second wedge is in contact with the first wedge. A force can be applied to the actuator lever through the remote emergency release lever creating linear motion of the link rod in the "X" direction. This motion causes the first wedge to force the stationary wedge to move in the "Y" direction. The movement of the stationary wedge disengages the output pinion of the gearmotor package from the internal gearing. When the output pinion is disengaged, the doors may be opened manually.

More specifically, according to this invention, there is provided an electrically driven entryway activation system for opening and closing two spaced swinging doors hung on spaced rotating parallel door posts. A base plate extends above the door opening and the door posts. Levers attached to each door post are journaled in hubs secured to the base plate. The levers rotate in a plane parallel to the base plate. A low profile actuation system is spaced between the levers attached to the door posts. The actuation system comprises a center post supported parallel to the door posts. A sector gear having teeth over at least a portion of the circumference thereof is journaled on the center post for rotation parallel to the base plate. A low profile gear motor is mounted between the base plate and the sector gear. The gear motor has a output pinion gear mounted for limited axial movement parallel to the center post. The gear in a raised position engages the teeth on the sector gear and in a lowered position can turn free of the sector gear. Two gear posts fixed to the sector gear extending parallel to the center post are radially spaced from the axis of the center post. Two connecting rods respectively extending between the gear posts and the levers are attached to each door post such that rotation of the sector gear causes rotation of the swinging doors. An emergency manual actuation mechanism is provided for disengaging the pinion gear from the sector gear.

BRIEF DESCRIPTION OF THE DRAWINGS

Further features and other objects and advantages will become apparent from the following detailed description made with reference to the drawings in which.

DESCRIPTION OF THE PREFERRED EMBODIMENTS

Figure 1:
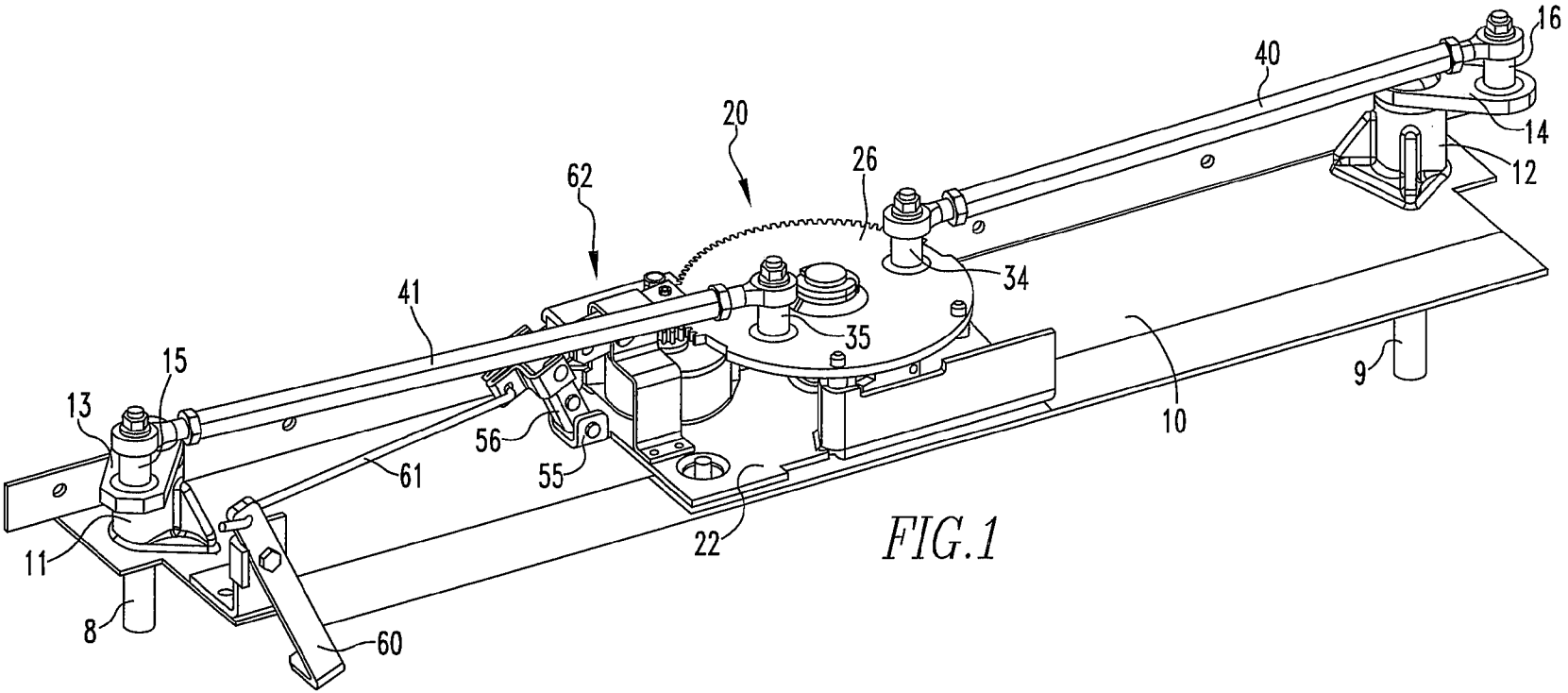
FIG. 1 is a perspective view of an electrically-driven entryway actuation system according to this invention.

Referring to FIG. 1, the electrically driven entryway activation system for opening and closing two spaced swinging doors is shown. At each end of a base plate 10 mounted above the door opening are located hubs 11, 12 that journal the rotating door posts 8, 9. Levers 13, 14 are fixed to each rotating door post. Extending from the levers 13, 14 are pivot posts 15, 16 which have an axis parallel with the door posts. The levers rotate in a plane parallel with the base plate 10.0

The hubs 11, 12 are preferably cast steel components that are welded to the base plate 10. A flange and supporting ribs may be present to help the device resist bending and reduce strain on welded joints. A bearing is inserted in the hubs for journaling the door posts.

A low profile actuation system 20 is fixed to the base plate between the hubs. The actuation means has a center post 21 supported relative to the base plate 10. The center post is parallel to the rotating door posts.

Figure 2:
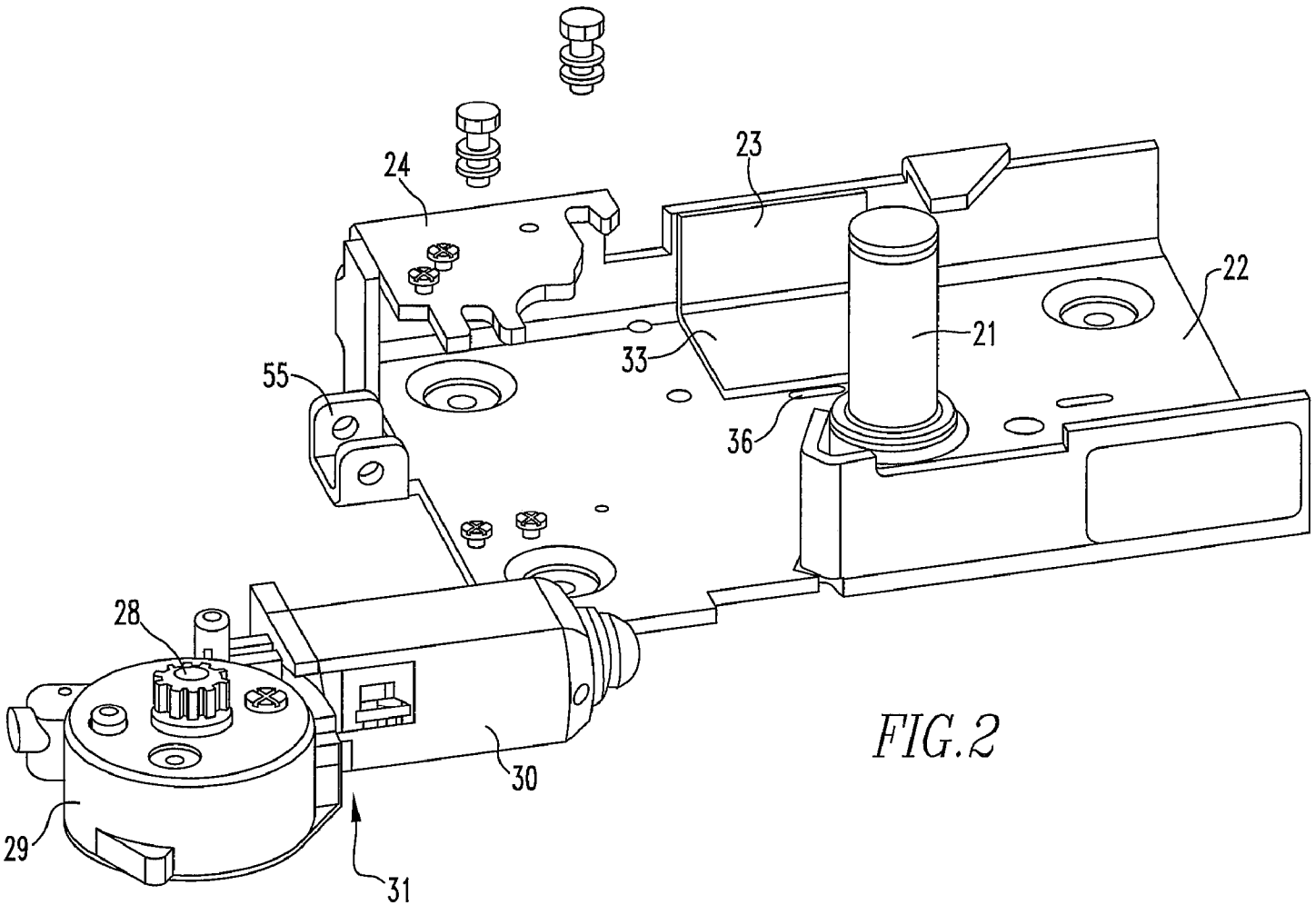
FIG. 2 is an exploded perspective view of a support plate and gearmotor as shown in FIG. 1.

As shown in FIG. 2, the center post 21 is fixed to an activation assembly support plate 22 that is bolted to the base plate 10. The assembly support plate 22 has an upturn edge 23 supporting a cantilevered mounting flange 24. The support plate, upturned edge and cantilevered support flange form a pocket into which an electric motor 30 of a gearmotor 31 can be captured. The gearmotor comprises an electric motor with a gear box 29 that supports and turns an output shaft (not shown) on which an output pinion 28 rotates around an axis perpendicular to the axis of the electric motor. The output shaft of the gear motor is journaled for a slight axial movement. When the output shaft is moved into the gear box, a clutch mechanism in the gear box allows the shaft to turn free of the electric motor. A suitable gear motor having a worm-base gear mechanism is sold by Bosch for use in automotive applications. Slots 32 in the support flange are positioned to align with mounting holes in the gearmotor.

Figure 3:
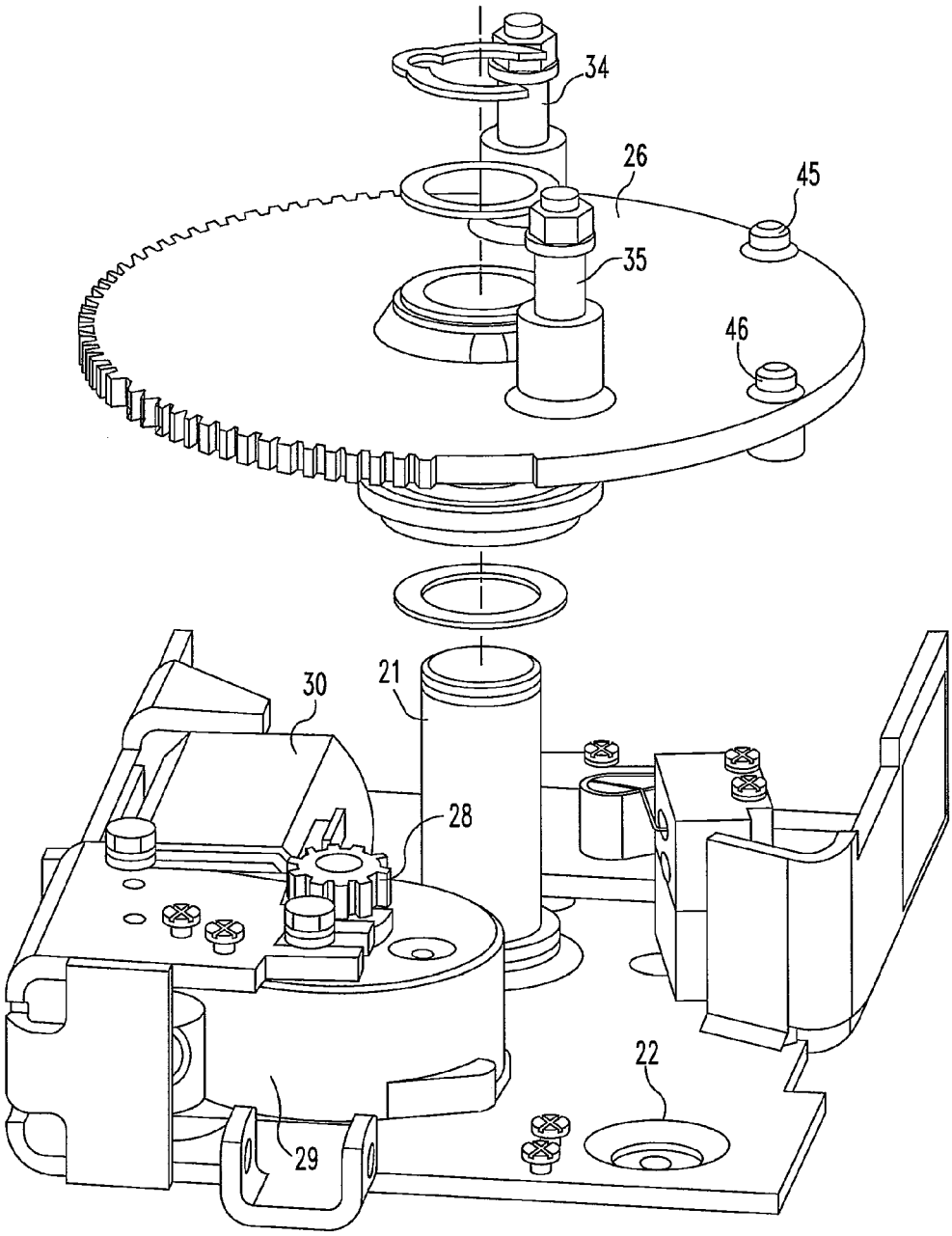
FIG. 3 is a partially exploded perspective view of a support plate, gearmotor and sector gear as shown in FIG. 1.

A sector gear 26 is journaled on the center post for rotation in a plane parallel to the base plate. The sector gear has gear teeth over at least a portion of the periphery of the sector gear. The electric motor is selected to slide into the pocket formed under the support flange and to extend into the volume between the activation assembly support plate and the sector gear. The motor is shown removed and in a position to be inserted into the pocket in FIG. 2. Along the upturned edge adjacent to the location of the motor when emplaced is an isolation pad 33. A slot 36 is provided in the assembly support plate so that a tie-wrap can be inserted to hold the motor in place against the isolation pad. FIG. 3 shows the motor placed in the pocket. The gear motor is positioned so that the output pinion 28 engages the teeth of the sector gear.

Referring to FIG. 3, the sector gear is placed over the center post and is held in place by a locking ring. The sector gear carries two pivot posts 34, 35 extending away from the base plate parallel to the center post. Connecting rods 40, 41 extend between the pivot posts 34, 35 and the pivot posts 15, 16 connected levers fixed to the door posts. The connections at each end of the connecting rods enable rotation around the respective pivot post. In a preferred embodiment, the connections at the ends of the connecting rods are ball type universal joints. Preferably, the lengths of the rods are adjustable. The connecting rods preferably have hexagonal (not rounded) shafts with threaded connection at each end for attaching the universal joints. The threads are tapered in opposite directions (i.e., one left-handed and one right-handed) so that by rotating the rod the length of the rod can be adjusted while installed.

The position of the pivot posts 34, 35 radially outward from the axis of the center post 21 is related to the position of the pivot posts 15, 16 on the respective levers 13, 14 relative to the axis of the respective door posts. In this way, a given rotation of the sector gear will provide a given rotation of the swinging doors. Preferably, door stop studs 45, 46 are mounted near the periphery of the sector gear on the side nearest the base plate. These are positioned to trip limit switches or engage stops when the sector gear has rotated to the position where the doors have either reached a fully open or fully closed position.

Figure 4:
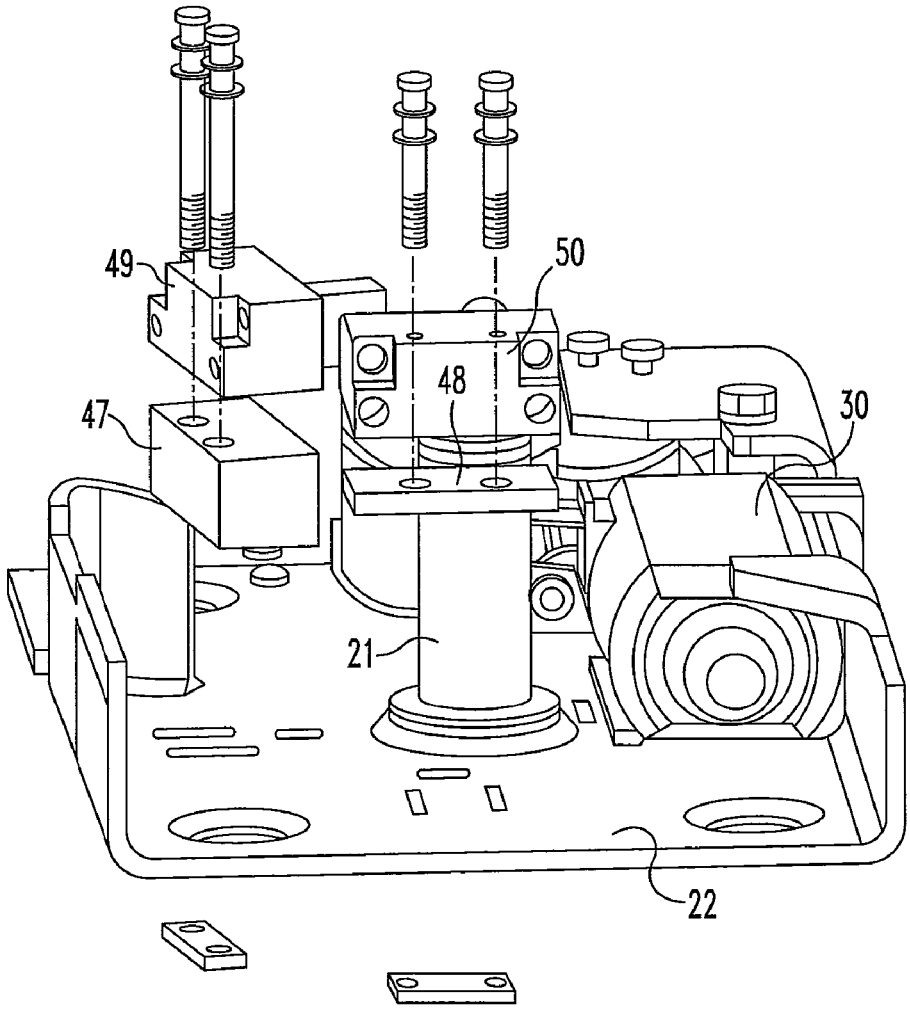
FIG. 4 is a partially exploded perspective view of a support plate and switches as shown in FIG. 1.

Referring to FIG. 4, spacers 47, 48 are bolted to the support plate to position indicator switches 49, 50 in a position beneath the sector gear to interact with the door stop studs. Mounting slots in the support plate for positioning the spacers and switches allow for movement toward and away from the center post to permit adjustment so that the switches align with the door stop studs.

The entryway activation system is provided with an emergency release mechanism. Normally, the doors can only be swung open by use of the gearmotor, and the gearmotor, output pinion and sector gear will prevent opening or closing of the doors manually. This is an intentional safety feature. An emergency release mechanism is therefore required. According to this invention, a suitable mechanism for depressing the output shaft is provided. This releases the clutch in the gearmotor and enables the output pinion and sector gear to freely rotate.

Attached to the support plate is a hinge 55. Pivoted in the hinge is an actuation lever 56. Rotation of this lever causes a mechanism (to be described) to depress the output shaft of the gearmotor. The actuation lever can be remotely actuated manually by a pivoted lever 60 and a connecting rod 61. The pivoted lever 60, connecting rod 61, actuation lever 56 and base plate comprise a four-bar linkage enabling remote manual actuation of the emergency release next described.

Figure 5A:
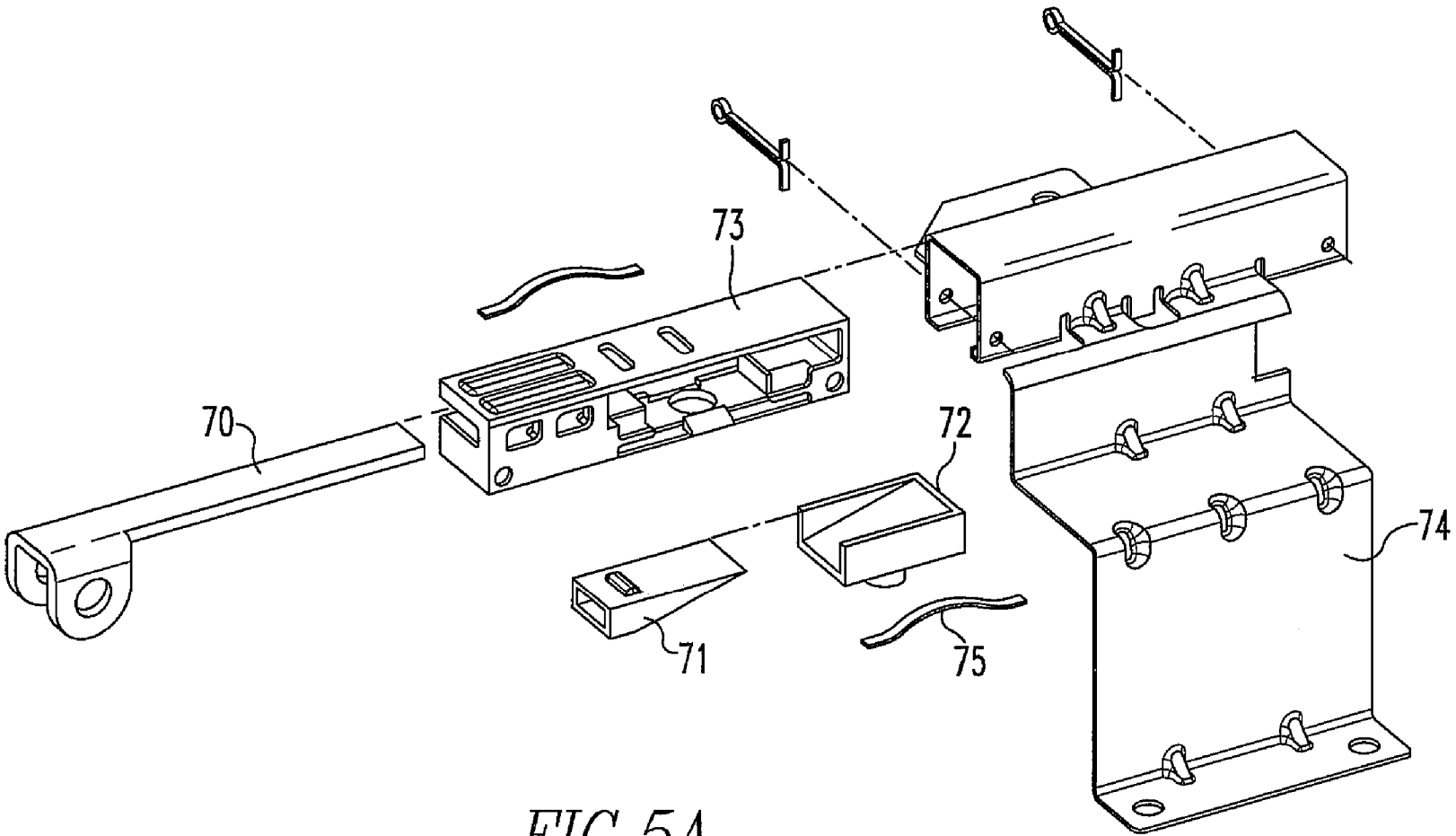
FIG. 5A is an exploded perspective view of a wedge type emergency release mechanism.
Figure 5B:
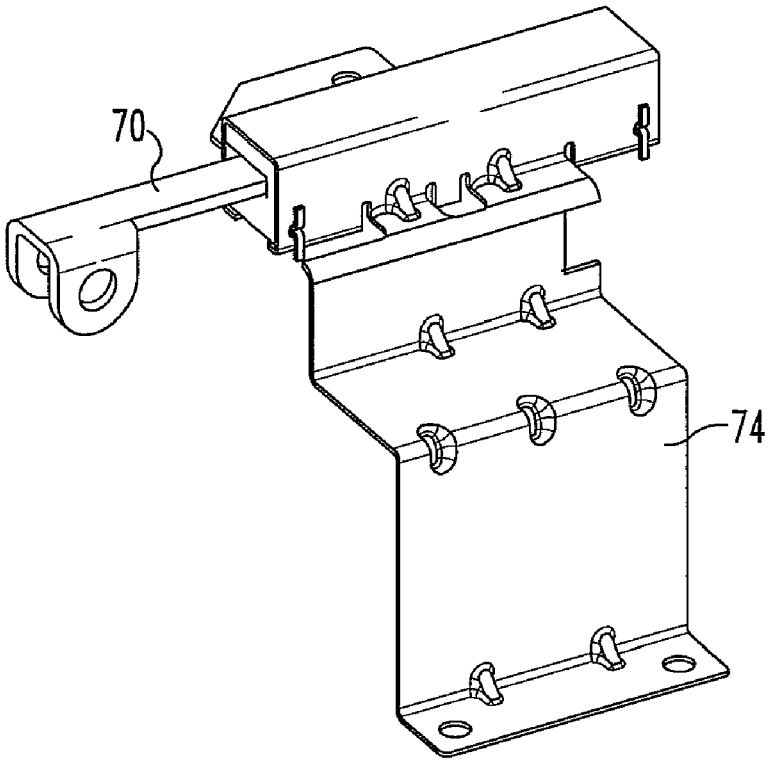
FIG. 5B is a perspective view of the assembled wedge type emergency release mechanism.

With reference to FIGS. 5A and 5B, a low profile sliding-wedge-style emergency release mechanism 62 is driven by actuator lever 56 having first and second ends. The first end is pivotally connected to the support plate 22 by hinge 55. The rod 61 extending from remote emergency release lever 60 (see FIG. 1) is connected between the first and second ends of the actuator lever. A link rod 70 connects with and forms an approximate 90° angle with actuator lever 56 at the second end of the actuator lever. A substantially horizontal first wedge 71 abuts link rod 70. A substantially horizontal stationary second wedge 72 has a beveled face in contact with a beveled face of the first wedge 71. A guide piece 73 has a slot in which the link rod is guided. The guide piece 73 has a second perpendicular slot in which the second wedge is guided. Springs 75 urge the second wedge upward as illustrated. A bracket 74 fixed to the support plate positions the guide piece 73 and the first and second wedges 71, 72 in a position just over the output pinion 28 but clear of the sector gear 26. A force can be applied to actuation lever 56 through remote emergency release lever 60 creating linear motion of link rod 70 in the "X" direction. This motion causes first wedge 71 to force second wedge 72 to move in the "Y" direction. The movement of second wedge 72 disengages output pinion 28 of gearmotor package 31 from the internal gearing by applying a force on a spring-loaded output shaft 27. When output pinion 28 is disengaged, the doors may be opened manually. FIG. 5B illustrates another view of the sliding wedge emergency release mechanism.

Figure 6A:
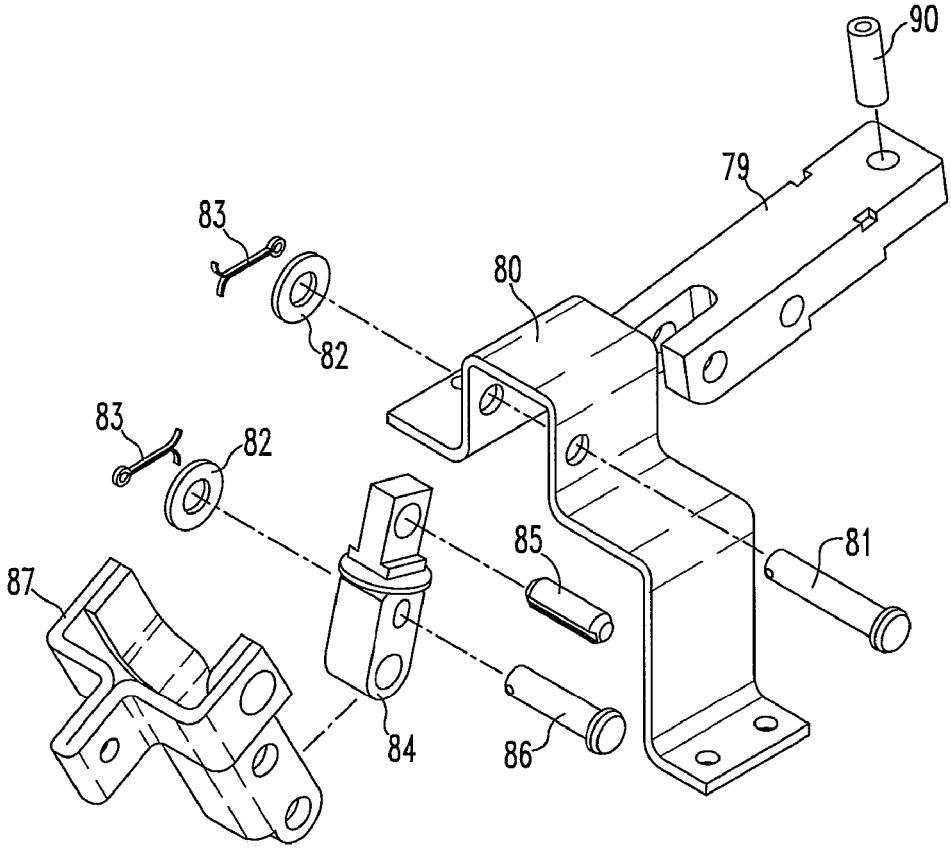
FIG. 6A is an exploded perspective view of a spring toggle type release mechanism.
Figure 6B:
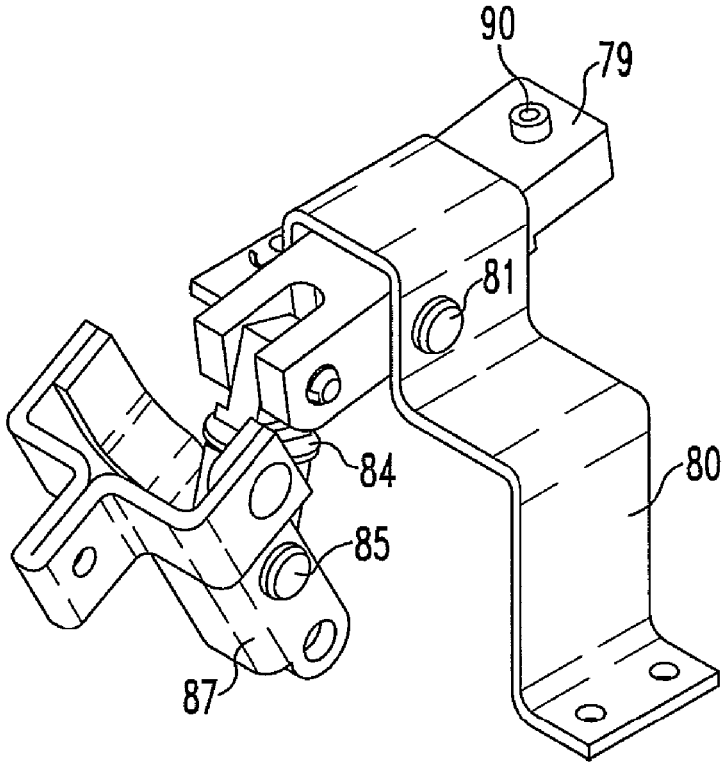
FIG. 6B is a perspective view of the assembled spring toggle type release mechanism.

Referring to FIGS. 6A and 6B, the spring-toggling emergency release mechanism now to be described includes features of the sliding-wedge-style emergency release mechanism as shown in FIGS. 5A and 5B. The spring-toggling emergency release mechanism uses parts, which may be machined, making it more effective for small quantity applications than sliding-wedge-style emergency release mechanisms. However, it has the disadvantages of increased space usage and a more complicated mechanical performance envelope.

With reference to FIGS. 6A and 6B, the spring-toggling emergency release mechanism includes an actuator bar 79 mounted to a mounting bracket 80 using a medium clevis pin 81 with one washer 82 and one cotter pin 83. The release mechanism further includes a spring linkage 84 with one end connected to actuator bar 79 using a roll pin 85 and the other end connected to a release lever 87 using a short clevis pin 86. The release mechanism also includes a strike-set screw 90 connected to actuator bar 79.

With reference to FIGS. 6A and 6B, the spring-toggling emergency release mechanism is connected to the support plate by mounting bracket 80 securing release lever 87 to the hinge 55 using a clevis pill, washer and cotter pin. A release return spring is also installed between the gearmotor and the actuator bar 79.

The purpose of each of the wedge type and spring-toggle type release mechanisms is to provide an axial displacement of the gear output pinion shaft, which disengages the clutch in the gearbox. When the clutch is disengaged, the main gear can rotate freely allowing the doors to be opened manually.

An advantage of the present invention is a low profile. This is possible because opening and closing the doors occurs in a more or less single plane of action (the levers, connecting rods and sector gear are moved in planes parallel to the base) thus helping to reduce inefficiency of operation. The low profile gearmotor being declutched by a slight axial movement of the output pinion makes possible the use of an emergency manual actuator that can be implemented in the space between the base plate and connecting rods that extend from the sector gear. The wedge based or toggle based emergency release mechanisms depressing the output pinion can be efficiently implemented in the space between the base plate and the connecting rods.

The system can also be easily altered to meet differing requirements. For instance, the radius of the inner leg on the sector gear assembly, the radius of the outer leg and the length of the adjustable rods are all easily changeable without new tooling. Further, the position of the stops can also be altered by changing the hole locations on the sector gear assembly during manufacture.

Having thus defined my invention in the detail and particularity required by the patent laws what is desired protected by Letters Patent are set forth in the following claims.

The invention claimed is:

1. In an electrically driven entryway activation system for opening and closing two spaced swinging doors hung on spaced rotating parallel door posts, a base plate extending between the door posts, levers attached to each door post journaled in hubs secured to the base plate, said lever rotating in a plane parallel to the base plate, a low profile actuation means spaced between the levers comprising:

a center post supported from the base plate parallel to the door posts, a sector gear having teeth over at least a portion of the circumference thereof and journaled on the center post for rotation parallel to the base plate, and a low profile gear motor mounted between the base plate and the sector gear, said gear motor having a output pinion gear mounted for limited axial movement parallel to the center post, said output pinion gear in a raised position engaging the teeth on the sector gear and in a lowered position disengaging teeth on the sector gear, two gear posts fixed to the sector gear extending parallel to the center post and being radially spaced from the center post, connecting rods respectively extending between the gear posts and the levers attached to each door post such that rotation of the sector gear causes rotation of the swinging doors, and a means for unclutching the pinion gear mounted on the base plate in the space between the base plate and the connecting rods by depressing the pinion gear.

2. The entryway activation system according to claim 1 wherein the means for unclutching the pinion gear comprises a toggle based device.

3. The entryway activation system according to claim 1 wherein the means for unclutching the pinion gears is a sliding wedge based device.

4. The entryway activation system according to claim 3 wherein the sliding wedge based device comprises first and second wedges with abutting beveled faces, the first wedge being guided by guide means to move in one direction and the second wedge being constrained to move in a second direction perpendicular to the movement of the first wedge.

5. The entryway activation system according to claim 1 wherein a lever hinged relative to the base plate may be remotely rotated and said lever having an unhinged end connected to actuate the means for unclutching the pinion gear.

6. The entryway activation system according to claim 1 wherein the means for unclutching is manually actuatable by movement of a first lever hinged relative to the base plate comprising one linkage of a four bar linkage.

* * * * *